US005577536A

United States Patent [19]

Maina

[11] Patent Number: 5,577,536

[45] Date of Patent: Nov. 26, 1996

[54] WEFT FEEDER FOR ELIMINATING YARN TENSION PEAKS

[75] Inventor: Bruno Maina, Valdengo, Italy

[73] Assignee: Nuova Roj Electrotex S.r.l., Biella, Italy

[21] Appl. No.: 428,179

[22] PCT Filed: Nov. 4, 1993

[86] PCT No.: PCT/EP93/03086

§ 371 Date: Jun. 29, 1995

§ 102(e) Date: Jun. 29, 1995

[87] PCT Pub. No.: WO94/10075

PCT Pub. Date: May 11, 1994

[30] Foreign Application Priority Data

Nov. 5, 1992 [IT] Italy ..... MI92A2544

[51] Int. Cl.[6] ..... D03D 47/34

[52] U.S. Cl. ..... 139/452; 242/47.01

[58] Field of Search ..... 242/47.01; 139/452

[56] References Cited

U.S. PATENT DOCUMENTS

| | | | |
|---|---|---|---|
| 4,828,192 | 5/1989 | Sarfati | 242/47.01 |
| 4,926,912 | 5/1990 | Zenoni | 139/452 |
| 5,123,455 | 6/1992 | Maina | 139/452 |
| 5,181,544 | 1/1993 | Deiuri | 139/452 |

FOREIGN PATENT DOCUMENTS

| | | | |
|---|---|---|---|
| 0051050 | 5/1982 | European Pat. Off. | 139/452 |
| 0330951 | 9/1989 | European Pat. Off. | 139/452 |
| 0436900 | 7/1991 | European Pat. Off. | 139/452 |
| 0534263 | 3/1993 | European Pat. Off. | 139/452 |
| 1529233 | 10/1978 | United Kingdom | 139/452 |

*Primary Examiner*—Andy Falik
*Attorney, Agent, or Firm*—Young & Thompson

[57] ABSTRACT

From a weft feeder (AT), weft yarn (T) is unwound from a reserve (R) on a drum (3) located at an outlet end of the weft feeder (AT). A yarn-braking device (1) includes a frusto-conical braking element (6) with varying flexibility and a cup support (8) with an open base. The braking element (6) has narrow tongues (7) placed side-by-side. In the braking element (6), the tongues (7) join together, at a major circumference, into a band (6A) with a smoothly and strictly continuous surface engaging an outlet end of the drum (3), while they are free and freely bear, at a minor circumference, against an inner periphery of the cup support (8). The braking element (6) is connected to the cup support (8) such that the former can be deformed and/or perform limited movements in every direction. An outlet yarn guide (4) is separate from the braking element (6) and is kept motionless, coaxial to the drum (3), while braking takes place.

14 Claims, 2 Drawing Sheets

WEFT FEEDER FOR ELIMINATING YARN TENSION PEAKS

BACKGROUND OF THE INVENTION

1. Field of the Invention

The present invention relates to a weft feeder for gripper or projectile looms.

2. Description of the Related Art

It is well known to feed weft yarn to machines making use thereof, in particular looms, by feeder devices or "weft feeders". These feeders are devices which are placed between a reel and the loom and which have as their function to store temporarily the weft yarn, facilitating its unwinding from the reel, and to supply it subsequently with preset optimum tension values to picking members.

The basic type of weft feeder which is in universal use today has an arm driven by an electric motor for winding the weft yarn in successive turns onto a winding drum, which is kept motionless.

Devices for controlling the quantity or reserve of weft yarn on the winding drum govern the rate and speed of rotation of the electric motor as a function of the quantity of weft yarn unwound by the loom, thus ensuring that the speed at which the weft yarn is unwound from the reel is kept as uniform as possible.

Where weft feeders are used on gripper or projectile looms, they are provided on their outlet side, for the purpose of imparting to the weft yarn fed to the loom a desired degree of tension, with braking devices downstream of the winding drum on which the reserve is wound. Many of the known braking devices act directly on an outlet end of the drum and are found upstream of an outlet yarn guide provided in order to ensure that the weft yarn is correctly unwound. In many weft feeders, the yarn-braking devices used consist of a plurality of natural or synthetic bristles and are fixed to a support in the form of a closed ring which is carried by a bracket with the possibility of moving along the principal axis of the weft feeder. The plurality of bristles bear, with a variable preloading that can be preset, by adjustment of an axial position of the bracket, on an outer periphery of the winding drum. In other yarn-braking devices, which act directly on the outlet end of the winding drum, a braking element with a varying flexibility is used and comprises a plurality of narrow tongues placed side-by-side on an inclined surface of a frustocone. This braking element is mounted on a cup support with an open base carried by a bracket and has a position which is adjustable along a central longitudinal axis of the drum. Examples of the latter yarn-braking devices comprising tongues in the form of metal drop-wires are illustrated in European Patent Nos. 49,897 and 436,900 belonging to the Applicant, in British Patent No. 1,529,233, and in European Patent No. 330,951.

However, even though the conditions under which the weft yarn is inserted into the loom have been improved in the yarn-braking devices mentioned above, the problem of controlling the tension of the weft yarn fed to the loom at an optimum value has not been fully or effectively resolved.

This problem becomes particularly troublesome during the weft insertion cycle in gripper looms in which the weft yarn is switched mid-shed, during which cycle the yarn must be kept at a high tension as it is gripped by the carrier gripper on entering the shed and as the end of the yarn is passed mid-shed from the carrier gripper to the puller gripper.

So, in the known yarn-braking devices discussed above, it is precisely the tendency which the weft feeders have of allowing the tension of the yarn when switched to fall below the requisite values, which tendency constitutes one of the main drawbacks of such feeders. These drawbacks are overcome by increasing the preset tension in order to maintain a sufficiently high tension at the switch-over point.

However, this increase in the preset tension means increasing the maximum value of the tension when that given by the inertia of the yarn at the time of maximum acceleration of the grippers, before and after the switch-over, is added to the preset tension produced by the braking action.

The resulting tension peaks are clearly not desired since they cause high stresses in the weft yarn, which stresses could easily lead to the yarn breaking.

The desirable feature of relieving tension peaks is obtained only partially with the weft feeder of the already cited European Patent No. 330,951, in which the flexible tongues of the braking element are rigidly fixed to a supporting ring being positioned in correspondence with the major diameter of the braking element itself and surrounding the drum. Thus, the braking element effects the braking in a discontinuous manner through separate tongues acting each on their own.

There is clearly a need, therefore, for weft feeders which, by keeping the tension of the weft yarn being fed to the loom as low as possible, in order for the loom to operate correctly, eliminate the damaging tension peaks which currently occur in the yarn (and obviously also the similarly damaging drops in tension), simultaneously ensuring the best operating conditions with respect to the gripping and switching of the weft yarn to the loom.

SUMMARY OF THE INVENTION

This need to eliminate tension peaks is fully satisfied by the present invention which relates to a weft feeder for gripper or projectile looms—of the type in which the weft yarn being fed to a loom is unwound from a reserve on a drum, on the outlet end of which, where a first weft yarn deviation takes place, there acts a yarn-braking device, upstream of an outlet yarn guide, where a second weft yarn deviation takes place, and in which the yarn-braking device, centered on the drum axis and adjustable along the drum, is of the type comprising a frustoconically shaped braking element with varying flexibility, carried by a support in the form of a cup with an open base. The inclined surface of the frustoconical braking element comprises a plurality of narrow tongues, placed side-by-side substantially along the generating lines of the frustocone. The tongues are reciprocally connected along the major circumference and are free along the minor circumference of the braking elements. In the braking element, the tongues join, in a region of the major circumference, into a band with a smooth and strictly continuous surface engaging the outlet end of the drum, while they freely bear, in a region of the minor circumference, against an inner periphery of the cup support. The braking element is connected to the cup support through at least two of the tongues, by allowing it to be deformed and/or to perform limited movements in every direction with respect to the cup support. The outlet yarn guide is separate from the braking element and is kept motionless, coaxial to the drum, while braking takes place.

In this weft feeder, the device for connecting the braking element of the yarn-braking device to its cup support comprises a plurality of pins, emerging from the cup support and engaging into slots formed in free ends of the tongues, as well as a ring fixed on ends of the plurality of pins.

The tongues of the braking element of the yarn-braking device are positioned along the generating lines of the frustoconical surface of the braking element or are positioned inclined and/or partially undulated with respect to the generating lines.

The band with a strictly continuous surface engaging the outlet end of the drum may be advantageously formed by applying onto the inner surface of the braking element, in the region of its major circumference, a frustoconical stiffening ring which increases the varying flexibility of the braking element.

BRIEF DESCRIPTION OF THE DRAWINGS

The invention will now be described in greater detail, by way of example, with reference to the preferred embodiments thereof, represented in the appended drawings, in which.

DETAILED DESCRIPTION OF THE PREFERRED EMBODIMENTS

Figure 1:
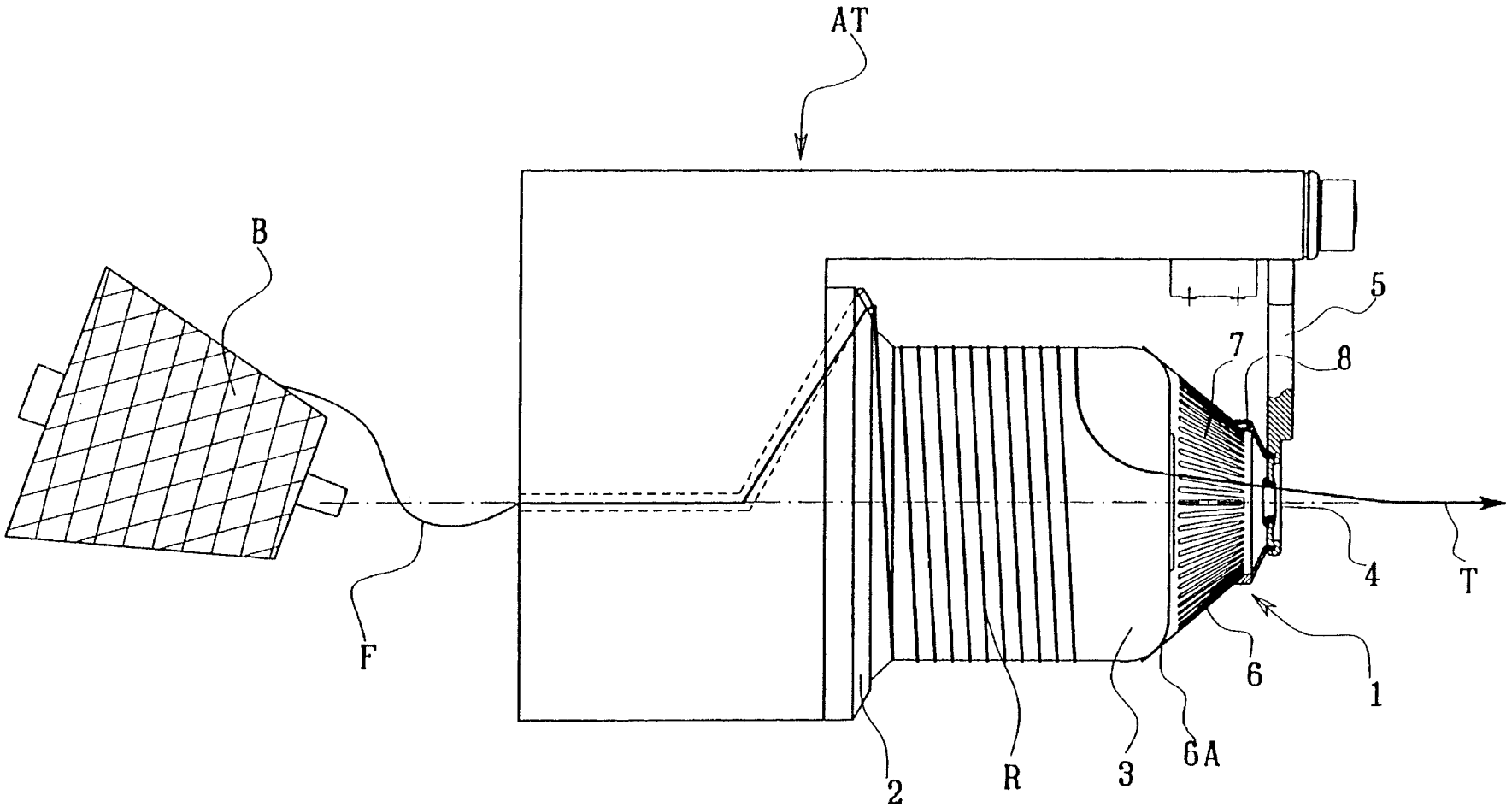
FIG. 1 shows a lateral overall view of the weft feeder according to the present invention.

FIG. 1 shows the weft feeder AT fed with yarn F from a bobbin B or reel and used to feed said yarn F as weft yarn T to a gripper or projectile loom (not shown).

In a known manner, in this weft feeder AT, a reserve R of the yarn F is wound by a winder 2 onto a drum 3 of the weft feeder AT in the form of turns. The weft yarn T is unwound undefiled by the loom from the reserve yarn R, and is guided by an outlet yarn guide 4, after having been subjected to a braking action in a region of a downstream end of the drum 3. The yarn guide 4 is supported by a bracket 5, along a longitudinal axis of the drum 3 and downstream therefrom. The quantity of reserve yarn R and the position of the yarn guide 4 along the axis of the drum 3 can be adjusted by varying the speed and the periods of operation of the winder 2 and the position of the bracket 5, respectively.

The braking action on the weft yarn T at the outlet yarn guide 4 is produced, in the weft feeder AT, by a yarn-braking device 1 comprising a braking element 6 having a frustoconical shape with a surface which for this purpose engages tangentially with the end of the drum 3 at its downstream periphery.

The braking element 6 of the weft feeder AT comprises a plurality of narrow tongues 7, placed side-by-side so as to form a frustoconical surface and oriented essentially along the generating lines of this frustocone. The tongues 7 are preferably metal drop-wires, though the use of other materials, whether natural or artificial, for example synthetic plastic materials, is by no means excluded, as long as these materials have a high flexibility. The tongues or drop-wires 7 are reciprocally connected along the major circumference of the frustoconical surface of the braking element 6, where the tongues 7 join into a broad-band 6A with a strictly continuous surface, engaging the downstream end of the drum 3, and are free in the region of the minor circumference, where they are mounted on an inner periphery of a cup support 8 with an open base.

The outlet yarn guide 4 can be separate from the cup support 8 of the yarn-braking device 1 or may be incorporated therein. It may additionally be fixedly mounted on the bracket 5, adjustable along the axis of the weft feeder AT and of the drum 3, or it may be mounted so that it can move on the bracket 5, adjustable along the same axis. The bracket 5 itself may be fixed to the weft feeder AT.

In the embodiment illustrated in FIG. 1, the yarn guide 4 is incorporated in the open base of the cup support 8 of the yarn-braking device 1, such that the open base of the cup support 8 and the outlet yarn guide 4 substantially coincide and are carried by the same bracket 5. By varying the position of the bracket 5, the distance between the drum 3 and the yarn guide 4 and between the drum 3 and the yarn-braking device 1 is also varied, as is therefore the braking action exerted by the latter on the downstream end of the drum 3.

Figure 2:
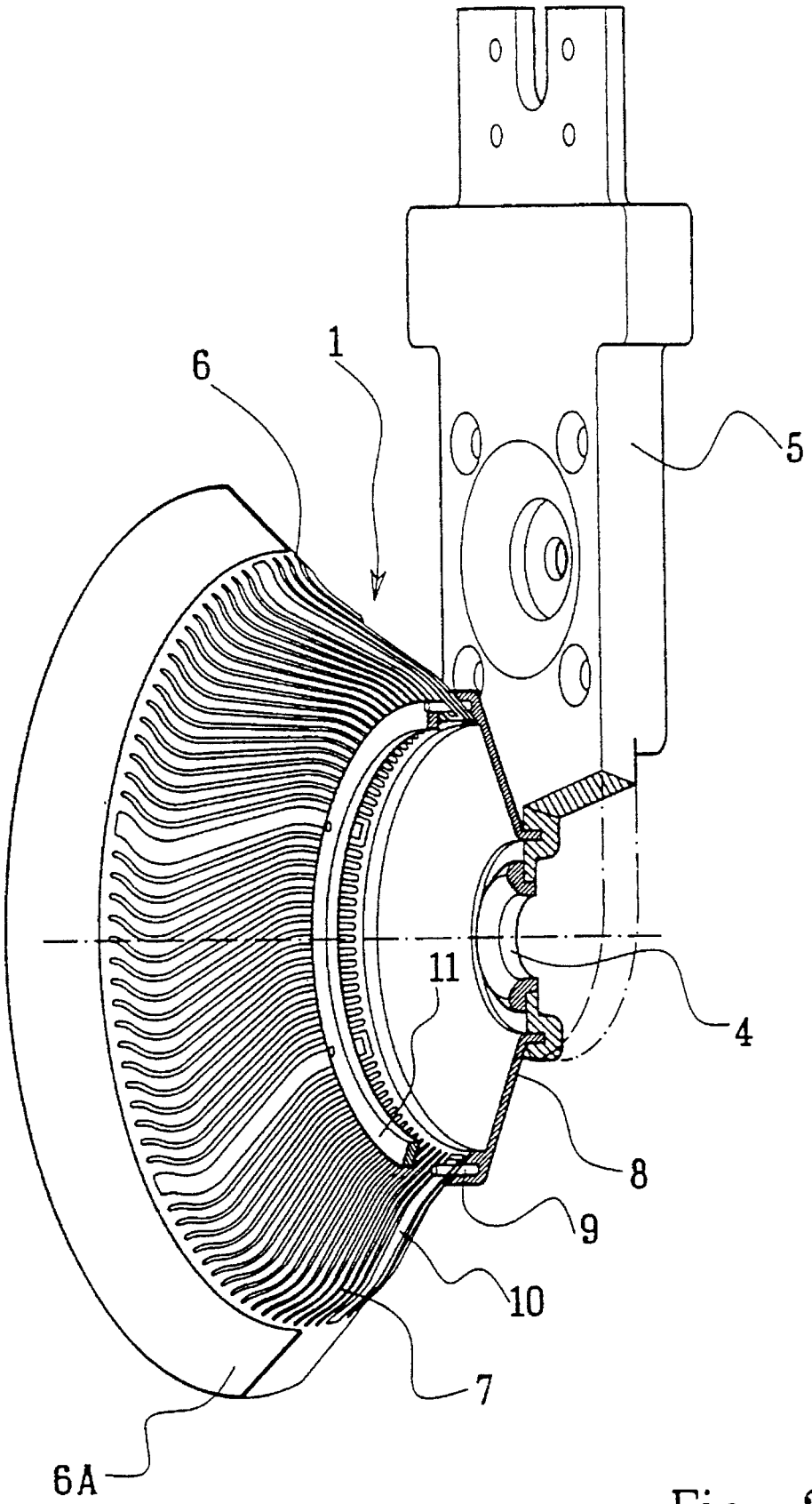
FIG. 2 is a detailed perspective view, in partial cross-section, of the yarn-braking device and of other parts of the weft feeder of FIG. 1.

As it is clearly shown in FIG. 2, the braking element 6 is connected to the cup support 8 through only some of the tongues or drop-wires 7 and through other structures allowing it to be deformed and/or to perform limited movements in every direction with respect to the cup support 8.

More precisely, the cup support 8 carries on its outer periphery a plurality of emerging pins 9 engaging into slots 10 formed in free ends of some of the tongues or drop-wires 7, as well as a locking ring 11 which is fixed, for example by pressure or by welding, onto the downstream ends of the pins 9, after the pins 9 have been inserted into the slots 10. The slots 10 are shown in FIG. 2 as joining the ends of pairs of the side-by-side tongues or drop-wires 7 which form the braking element 6, but the slots 10 could also be formed in a different manner (for example directly as slots 10 in the free ends of some of the uniformly spaced tongues or drop-wires 7 which form the braking element 6).

As has already been described, the structure of the braking element 6 means that the tongues 7 are positioned substantially along the generating lines of the frustoconical surface. FIG. 1 illustrates straight tongues 7, arranged exactly along the generating lines, whereas FIG. 2 shows tongues 7 in the form of drop-wires which are positioned inclined and/or partially undulated with respect to the generating lines of the frustoconical surface of the braking element 6.

As it has already been described in regard to FIG. 1, the braking element 6 bears against the downstream end of the drum 3 via its band 6A in order to exert a braking action on the yarn F which is unwound undamaged from the drum 3 towards the yarn guide 4 of the weft feeder AT. The band 6A must ensure that contact between the drum 3 and the yarn F is as uniform as possible in order to prevent harmful peaks or drops in tension in the weft yarn T itself. For this purpose, the surface of the band 6A is smooth and strictly continuous, without any significant interruption. Therefore, the band 6A can be made as one piece with the tongues 7 forming the braking element 6, or the band 6A can be applied in various ways to the inside of the upstream end of the braking element 6 at its greater circumference. In this second case—illustrated in FIG. 2 (in which the representation of the band 6A is interrupted at the bottom)—it may prove expedient to form the band 6A as a drawn metal ring which, by stiffening the end of the braking element 6, advantageously increases the varying flexibility of this braking element 6.

The specific configuration of the yarn-braking device 1—and principally the mounting thereof which enables the braking element 6 to be greatly deformed and to be moved to a moderate degree in all directions on the cup support 8 (namely a mounting in the manner of a universal joint which guarantees complete freedom), the varying flexibility of the structure of the braking element 6 and the continuity of the surface of its band 6A engaging with the drum 3—mean that the yarn-braking device 1 is best adapted in the area of tangency with the drum 3 to the deformations caused by the passage of the weft yarn T.

The features of the yarn-braking device 1 described above are combined:

with the presence of the outlet yarn guide 4, which is separate from the braking element 6 of the yarn-braking device 1 and is kept motionless while braking takes place, and which the yarn F reaches while passing freely through the space within the braking element 6 without being deviated therein (in fact the weft yarn T only undergoes a first deviation in the region of the braking zone, at the downstream end of the drum 3, and only undergoes a second deviation in the region of the outlet yarn guide 4); and with the positions of the outlet yarn guide 4 and of the cup support 8 of the yarn-braking device 1 which can be adjusted along the axis of the drum 3 (so as to graduate the braking action).

All this means that the weft feeder AT solves—using devices which are very reliable and which do not require maintenance or frequent replacement—the problem of eliminating damaging peaks or drops in the tension of the weft yarn T or at least reduces this phenomenon to a level which is acceptable as regards the practical requirements of weaving, even on the most technologically advanced looms.

The underlying solutions which form the subject of the invention may, of course, be adapted to the individual requirements of the weft feeders AT and of the various machines to which they are applied, by making adjustments of a design nature, such as in the choice of materials, the number and the design of, and the distance between, the tongues 7 which form the braking element 6, the method and materials used to make the band 6A of this braking element 6, the way in which the braking element 6 and its cup support 8 are joined at the construction stage, the structure and mounting of the outlet yarn guide 4, and the structure and mounting of the cup support 8. With particular reference to the last two items (as has already been seen, the cup support 8 of the yarn-braking device 1 and the outlet yarn guide 4 may be separate or may be incorporated one inside the other), an interesting and alternative solution to that illustrated embodiment would consist in mounting the cup support 8 of the yarn-braking device 1 so that it can move with respect to the bracket 5 which is fixed to the weft feeder AT, with the possibility of adjusting the position of the cup support 8 along the axis of the drum 3, for example using screws carried on the bracket 5, which screws are coaxial to the axis of the drum 3.

All of the above adjustments and any other embodiment which is a variant of the weft feeder AT described above and illustrated herewith will, of course, be encompassed by the scope of the present invention.

I claim:

1. A weft feeder for gripper or projectile looms comprising:

a drum (3) having a longitudinal axis, a downstream end, and an upstream end;

a yarn guide (4) located at an outlet end for weft yarn (T) being fed therefrom;

a yarn braking device (1) being positioned between the drum (3) and the yarn guide (4) and being centered on the longitudinal axis of the drum (3);

a braking element (6) of the yarn-braking device (1) lying along an inclined surface of a frustocone;

a cup support (8) carrying the braking element (6) and having an inner periphery;

a plurality of tongues (7), placed side-by-side, forming the inclined surface substantially along generating lines of the frustocone and being connected together along a major circumference of said frustocone, said plurality of tongues (7) having free ends along a minor circumference of the frustocone to bear against the inner periphery of the cup support (8); and means (9, 10, 11) for allowing the braking element (6) to be deformed and/or to perform limited movements in every direction with respect to the cup support (8);

whereby said braking element (6) is connected to the cup support (8) through at least two of the plurality of tongues (7) and also whereby said yarn guide (4) is separated from the braking element (2) while braking takes place.

2. A weft feeder, as recited in claim 1, further comprising:

a bracket means (5) for mounting the cup support (8) around the yarn guide (4).

3. A weft feeder, as recited in claim 1, further comprising:

a weft yarn reserve (R) wound on the drum (3).

4. A weft feeder, as recited in claim 1, further comprising:

a band (6A) with a continuous surface engaging the downstream end of the drum (3).

5. A weft feeder, as recited in claim 4, wherein:

said band (6A) is a frustoconical stiffening ring.

6. A weft feeder, as recited in claim 5, wherein:

said stiffening ring is made of metal.

7. A weft feeder, as recited in claim 1, further comprising:

a winder means (2) for engaging the upstream end of the drum (3).

8. A weft feeder, as recited in claim 1, wherein:

said allowing means (9, 10, 11) includes a plurality of pins (9) emerging from the inner periphery of the cup support (8), slots (10) formed at the free ends of the plurality of tongues (7), and a ring (11) fixed on the plurality of pins (9).

9. A weft feeder, as recited in claim 8, wherein:

said slots (1) are formed by joining the free ends of adjacent pairs of the plurality of tongues (7).

10. A weft feeder, as recited in claim 8, wherein:

said slots (10) are formed by joining some of the free ends of the plurality of tongues (7).

11. A weft feeder, as recited in claim 1, wherein:

said plurality of tongues (7) each lie straight along the generating lines of the frustocone.

12. A weft feeder, as recited in claim 1, wherein:

said plurality of tongues (7) each lie partially undulated along the generating lines of the frustocone.

13. A weft feeder, as recited in claim 1, wherein:

said yarn guide (4) is incorporated into the cup support (8).

14. A weft feeder, as recited in claim 1, wherein:

said yarn guide (4) forms an open base for the cup support (8).

* * * * *